US006979256B2

(12) United States Patent
Cooper et al.

(10) Patent No.: US 6,979,256 B2
(45) **Date of Patent: *Dec. 27, 2005**

(54) RETAINING RING WITH WEAR PAD FOR USE IN CHEMICAL MECHANICAL PLANARIZATION

(75) Inventors: Richard D. Cooper, Sullivan, IN (US); Paul Fathauer, Sullivan, IN (US); Angela Mroczek-Petroski, Crawfordsville, IN (US); David Perry, Crawfordsville, IN (US); James P. Macey, Crawfordsville, IN (US)

(73) Assignee: Raytech Innovative Solutions,LLC, Sullivan, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/924,715

(22) Filed: Aug. 24, 2004

(65) Prior Publication Data

US 2005/0026554 A1 Feb. 3, 2005

Related U.S. Application Data

(63) Continuation of application No. 10/156,655, filed on May 28, 2002, now Pat. No. 6,899,610.

(60) Provisional application No. 60/295,472, filed on Jun. 1, 2001.

(51) Int. Cl.[7] ..... B24B 5/00
(52) U.S. Cl. ..... 451/397; 451/287; 451/398
(58) Field of Search ..... 451/397, 285–289, 451/28, 41

(56) References Cited

U.S. PATENT DOCUMENTS 5,645,474 A * 7/1997 Kubo et al. ..... 451/287
6,179,694 B1 * 1/2001 Quek ..... 451/286
6,245,193 B1 * 6/2001 Quek et al. ..... 156/345.14
6,390,904 B1 * 5/2002 Gleason et al. ..... 451/286
6,899,610 B2 * 5/2005 Cooper et al. ..... 451/397

* cited by examiner

*Primary Examiner*—Lee D. Wilson
(74) *Attorney, Agent, or Firm*—Milton S. Gerstein; Much,Shelist,Freed

(57) ABSTRACT

A novel retaining ring having a wear pad of such construction, design and material such that it provides improved resistance to wear and/or degradation as compared to currently available products for use in the chemical mechanical planarization (CMP) of semiconductor wafers and similar materials. The retaining ring with wear pad of the invention is able to withstand increased operating temperatures and pressures at the polishing surface of the wafer with less wear than would normally be encountered with currently used materials and designs. The ability to operate at increased temperature and pressure can accelerate the rate of removal of material from a semiconductor wafer in some processes. The flexibility of a manufacturer to use an expanded range of temperature and pressure in CMP processes, combined with a significant reduction in the cost of consumables, provides a significant advantage in the final cost of ownership in the production of multilayer, integrated circuit devices and other products where CMP is utilized in manufacture. Moreover, the retaining with wear pad of the present invention may also retrofitted to previously used and worn retaining rings of the prior-art design, thus salvaging the major structural component of the CMP processing apparatus, thereby reducing costs. It is also an integral part of this invention to make the consumable component of the new design replaceable, so as to make replacement of this part less costly when such replacement finally does become necessary.

9 Claims, 7 Drawing Sheets

RETAINING RING WITH WEAR PAD FOR USE IN CHEMICAL MECHANICAL PLANARIZATION

CROSS REFERENCE TO RELATED APPLICATION

Priority of provisional application Ser. No. 60/295,472, filed on Jun. 1, 2001, is hereby claimed.

This application is a Continuation of Ser. No. 10/156,665 filed May 28, 2002, now U.S. Pat. No. 6,899,610.

BACKGROUND OF THE INVENTION

Enabling technology for the manufacture of multiple layer integrated circuit devices has been chemical mechanical planarization (CMP). In this process, each layer of wiring devices or of insulating material is polished flat (planarized) prior to deposition of the next layer. CMP facilitates the construction of multi-layer integrated circuit devices by reducing irregularities in surface topography to an acceptable level, to thus prevent defects such as short circuits or open circuits as the layers are built up.

The machinery to perform CMP has become highly sophisticated and efficient, with equipment costing millions of dollars. Nevertheless, there are some components of this equipment that require frequent replacement during the polishing operation, and are classed as consumables. These parts contribute significantly to the high costs of CMP equipment operation. One of these short-lived, consumable components is the retaining ring, which is part of the polishing head assembly (alternatively called the wafer carrier). The retaining ring serves to hold the semiconductor wafer and keep it in place during the polishing operation where it is forced against the polishing pad. The retaining ring conventionally consists of a stainless steel body to which a non-metallic wear member is attached. The non-metallic wear member surrounds the wafer, while the bottom surface of the wear member contacts the polishing pad directly. A flexible diaphragm within the polishing head above the wafer applies downward pressure on the wafer. Thus, the wafer is entrapped in a cavity created by the retaining ring assembly, the polishing pad below, and the flexible diaphragm above. Downward pressure on the retaining ring is applied independently of the flexible diaphragm, and can be varied in order to prevent the wafer from forcing its way out and being destroyed. The non-metallic part of the retaining ring is the only part that is in contact with the polishing pad in addition to the wafer. As such, it is subject to the polishing action of the polishing pad and the abrasive slurry.

Current retaining ring construction materials, although having other desirable properties, do not have good wear resistance. The average life of presently available retaining rings is approximately 500 wafers under normal circumstances. At increased temperature and pressure, this will be significantly lower. Replacement of the retaining ring on a regular basis adds substantially to the cost of ownership of the CMP process machinery. Under current practice, the entire retaining ring assembly is generally discarded and replaced with a new one. It would, therefore, be highly desirable to develop a retaining ring with increased useful life, with the capability of operating at increased temperatures and pressures, and which has the capacity of replacing only its wear-surfaces. One prior-art retaining ring currently available is manufactured of polyphenylene sulfide (PPS). This material seems satisfactory in most regards, but requires frequent replacement as the material wears. The typical lifetime of current designs is about 500 wafers.

In commonly-owned, copending application Ser. No. 10/087,223, filed on Mar. 1, 2002, which application is incorporated by reference herein, there is disclosed a polishing pad made of fibrous construction, which may include various natural or synthetic fillers, abrasives or friction modifiers, the whole matrix being bound together by a thermosetting resin, densified, and heat cured under pressure to produce a rigid, yet, porous, structure. One or both surfaces of the polishing pad of the invention are ground, sanded, or the equivalent, to lift and expose fibers in a random, three-dimensional pattern that becomes the active polishing surface or surfaces. The basic fiber matrix may be any natural or synthetic fiber or blend thereof that is felted, dry laid, wet laid, woven, carded, spun, blown, or any other process that produces a porous fiber matrix that can be resin-impregnated and processed as above.

SUMMARY OF THE INVENTION

It is, therefore, the primary objective of the present invention to provide a retaining ring for use in retaining a wafer during polishing by a CMP apparatus, which has a wear pad associated therewith of such construction, design and material such that it provides improved resistance to wear and/or degradation as compared to currently available products for use in the chemical mechanical planarization (CMP) of semiconductor wafers and similar materials.

It is yet another objective of the present invention to provide such a retaining ring with a wear pad, which wear pad is made of comprised of fibrous material impregnated with a thermosetting resin.

It is yet another objective of the present invention to provide such a retaining ring with a wear pad, with an insulating layer being interposed between the wear pad and the bottom surface of the retaining ring, whereby heat generated during wafer-polishing is better retained in order to elevate the temperature at which wafer-polishing is performed.

It is yet another objective of the present invention to provide such a retaining ring with a wear pad, which wear pad has a bottom surface that may be either ground and/or provided with hard abrasive additive.

It is yet another objective of the present invention to provide a means of re-using retainer rings of the prior art by retrofitting them with the wear pad of the present invention.

The retaining ring with wear pad of the invention is able to withstand increased operating temperatures and pressures at the polishing surface of the wafer with less wear than would normally be encountered with currently used materials and designs. The ability to operate at increased temperature and pressure can improve the polishing removal rate in some processes such as tungsten, copper and oxide. The flexibility of a manufacturer to use an expanded range of temperature and pressure in CMP processes, combined with a significant reduction in the cost of consumables, provides a significant advantage in the final cost of ownership in the production of multilayer, integrated circuit devices and other products where CMP is utilized in manufacture. Moreover, the retaining-ring wear pad of the present invention may also retrofitted to previously used and worn retaining rings of the prior-art design, thus salvaging the major structural component of the CMP processing apparatus, thereby reducing costs. It is also an integral part of this invention to make the wear pad of the invention replaceable, so as to obviate the necessity of replacement of an entire retaining ring, resulting in considerable cost-savings.

BRIEF DESCRIPTION OF THE DRAWINGS

The invention will be more readily understood with reference to the accompanying drawings, wherein.

DETAILED DESCRIPTION OF THE INVENTION

Figure 1:
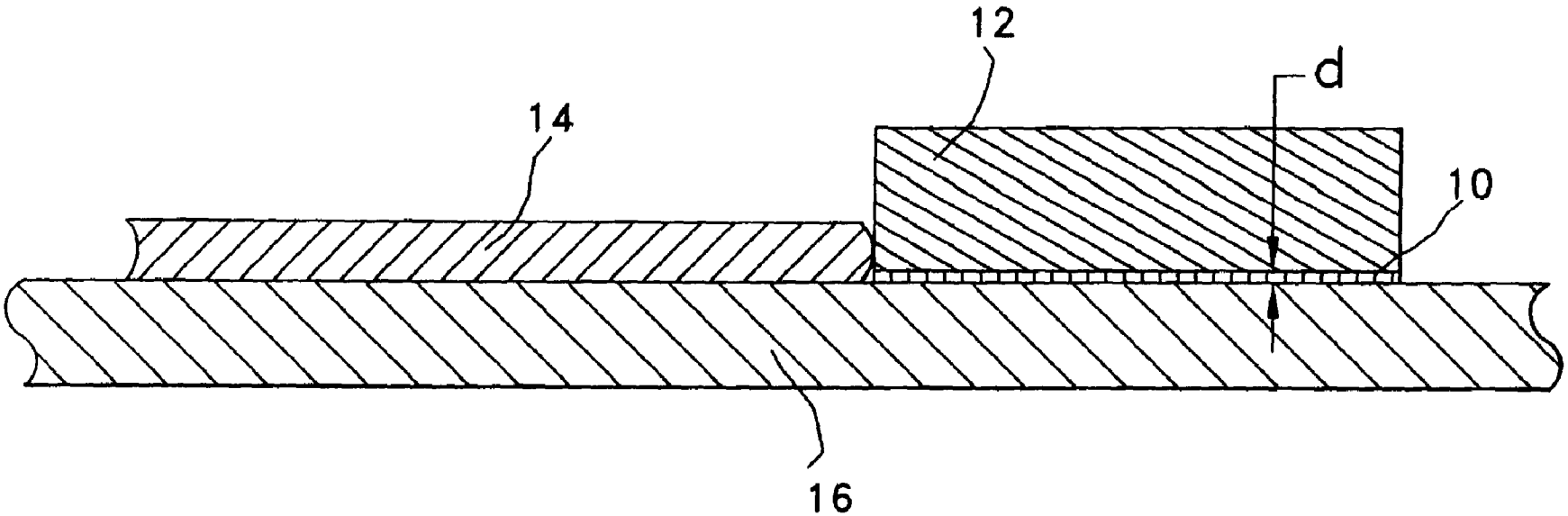
FIG. 1 is a cross section of a first embodiment of the retaining ring with wear pad for use in CMP processes, wherein a thin (0.010 of an inch or less) wear pad is adhesively attached to the bottom of a retaining ring that is constructed of a thermoplastic material, with the semiconductor wafer being shown abutting the inside diameter of the retaining ring, and with the bottom surfaces of the wafer and the wear pad being in contact with the polishing pad.

Referring to the drawings in greater detail, there is shown in FIG. 1 a cross section of the first embodiment of the annular retaining ring with wear pad for use in CMP processes, wherein a thin, 0.010 of an inch or less, annular wear pad 10 is adhesively attached to the bottom of annular retaining ring 12, which retaining ring is constructed of a thermoplastic material, such as PPS. A semiconductor wafer 14 to be polished by a polishing head of a CMP apparatus is shown abutting the inside annular surface of the retaining ring 12 and retained thereby. The bottom surface of the wafer 14 and the annular wear pad 10 are in contact with polishing pad 16 of a conventional polishing head assembly described hereinbelow with reference to FIG. 2. The embodiment of FIG. 1 significantly reduces retaining-ring wear by replacing about 0.010 inches or less at the contact surface of the retaining ring with about 0.010 inches or less of the thick wear pad 10 of material bonded to the PPS of the retaining ring. While the wear pad withstands the heat and abrasion from the polishing pad, the PPS absorbs the impact from the wafer.

While presently available retaining rings last on average about 500 wafers polished before being replaced, the retaining ring of the present invention lasts approximately 2,500 wafers polished, about 5 times as long. Additional savings result from the reduction in down time required to change out worn retaining rings. This is under normal conditions. Furthermore, it has been found that in some CMP processes, notably tungsten CMP, increased operating temperature and pressure increase the rate of removal of tungsten. Under these conditions, prior-art, retaining-ring life is reduced even further. Excessive wear of prior-art, retaining rings at elevated pressure and/or temperature also increases defects by adding to particulate contamination on the wafer. With the present invention, the savings in cost of ownership for longer life and reduced downtime is significant. Making the wear-pad section replaceable reduces this cost even further. With consideration to the potential performance increase, the savings may be dramatic.

The wear pad of the invention is constructed of a fibrous matrix that has been impregnated with a thermosetting resin and dried, densified and cured under heat and pressure to create a rigid semi-porous structure. The surface of the retaining-ring wear pad that contacts the polishing pad is ground or sanded, if desired, or may be left "as molded", depending on the frictional performance required for the intended use. In some cases, the densification process results in a non-porous structure.

The basic fiber matrix is preferably any natural or synthetic fiber or blend that is felted, wet-laid, dry-laid, carded, spun, blown, woven, or other process that produces a porous fibrous matrix that can be resin-impregnated and processed as described above. Various natural or synthetic fillers of a suitable nature may also be incorporated into the base structure as needed in order to obtain specific physical characteristics. The preferred resin impregnation is with a thermosetting resin, such as phenolic, epoxy, silicone, or the like, although certain high-temperature thermoplastic resins may also be used. In one example, the wear-pad material is a wet-laid cotton fiber matrix that has been densified to a desired density. This fiber matrix is then impregnated with a phenolic resin to desired resin content, dried, and cured under heat and pressure to a semi-porous state, with the wear pad having a ground surface. Hard, abrasive particles may be incorporated into the material of the wear pad of the invention in order to condition the polishing pad during the polishing process. This conditioning generally improves the performance of the polishing pad. Pad conditioning is conventionally accomplished by means of a separate conditioning pad of the CPM apparatus that periodically conditions the polishing pad. The abrasive-particle additive that may be used may be diamond, diamond dust, aluminum oxide, colloidal alumina, aluminum silicate, clay aluminum silicate, colloidal silica, amorphous silica, silicon carbide, zirconia-alumina, cubic boron nitride, boron carbide, celite, ceramics, garnet, emery, pumice, iron oxide, feldspar, cerium oxide, fused alumina or tripoli, or other conventional materials.

The wear pad of the present invention has the distinct advantage of allowing the use of wear-resistant and impact-resistant fillers in the pad material in order to increase life. This has not been preferable in prior-art, conventional retaining rings, since such fillers would be released onto the surface of the polishing pad, thereby, causing defects on the wafers being polished. In the present invention, fillers, abrasives and the like are less likely to be released onto the polishing pad.

Reference is had to copending application Ser. No. 10/087,223, filed on Mar. 1, 2002, which application is incorporated by reference herein, in which is disclosed a polishing pad made of fibrous construction, which may include various natural or synthetic fillers, abrasives or friction modifiers, the whole matrix being bound together by a thermosetting resin, densified, and heat cured under pressure to produce a rigid, yet porous, structure. One or both surfaces of the polishing pad of the invention are ground, sanded, or the equivalent, to lift and expose fibers in a random, three-dimensional pattern that becomes the active polishing surface or surfaces. The basic fiber matrix may be any natural or synthetic fiber or blend thereof that is felted, dry laid, wet laid, woven, carded, spun, blown, or any other process that produces a porous fiber matrix that can be resin-impregnated and processed as above the wear-pad material of the present invention is preferably made similarly to the polishing pad material of this copending application. In some uses, however, the density of the wear pad is greater than that of the polishing pad disclosed in said application Ser. No. 10/087,223.

The wear-pad material is a matrix of absorbent fibers, such as cellulose fiber, which may include cotton linters and wood pulp, such as hardwood and softwood, and which are impregnated with a thermoset resin, preferably phenolic, is densified, grooved, if desired, and cured to provide a rigid, yet porous structure. Other thermoset resins may be used, such as silicones, epoxies, blends thereof, and the like. The fibers that may be used are: natural or synthetic including cellulose, wood pulp, "ARAMID", rayon, linen, carbon, graphite, polyamide fiber, polymer fiber, lyocell fiber, engineered fibers, etc, and combinations thereof. The cross-sectional diameters of the fibers may be between 10 and 50 microns, with a preferred range of between 15–35 microns. The length is preferably in the range of between 0.4 and 1.3 mm., although it is to be understood that fiber-lengths somewhat shorter or longer may be used effectively. The fibrous matrix constitutes approximately 30–80% by weight of the wear-pad material. In one form, the wearing pad surface is ground to achieve a surface finish of 1–25 mm $R_a$. If well-known, hard, abrasive particles are added as fillers to the wear pad material, such may be in the range of between approximately 10–500 microns in diameter, depending upon the specific use and desired properties. The density of the wear-pad is preferably in the range of approximately in the range of 0.3 to 2.0 g/cm$^3$. The manufacture of the wear-pad material may be accomplished by any of those methods disclosed in above-mentioned co pending application Ser. No. 10/087,223. Application of the wear-pad surface to the bottom surface of a retaining ring may be accomplished by well-known methods, such as molding, etching, photolithography, and the like.

Figure 2:
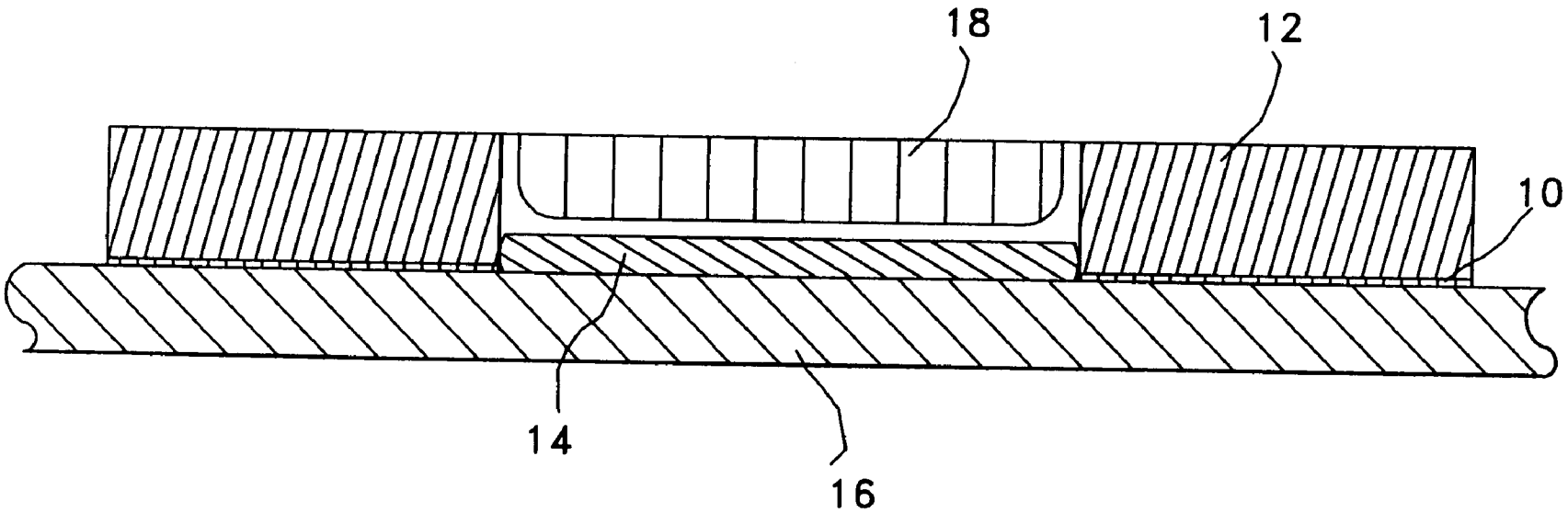
FIG. 2 is an enlarged cross sectional view of FIG. 1 showing a conventional polishing head with the retaining ring and wear pad, where separate diaphragms apply distinct downward pressures to the wafer and retainer ring assembly as the wafer is being polished.

FIG. 2 is a cross sectioned view of a typical polishing head (alternatively called a wafer carrier). The annular wear pad 10 is of the embodiment of FIG. 1, which is secured to the retaining ring body 12. The retaining ring secures wafer 14 to be polished by a polishing pad 16, against which wafer there is applied a downward pressure by means of a conventional flexible diaphragm 18. The retaining ring 12 and the flexible diaphragm 18 have separate and distinct pressure supplies that can be adjusted and controlled independently.

Figure 3:
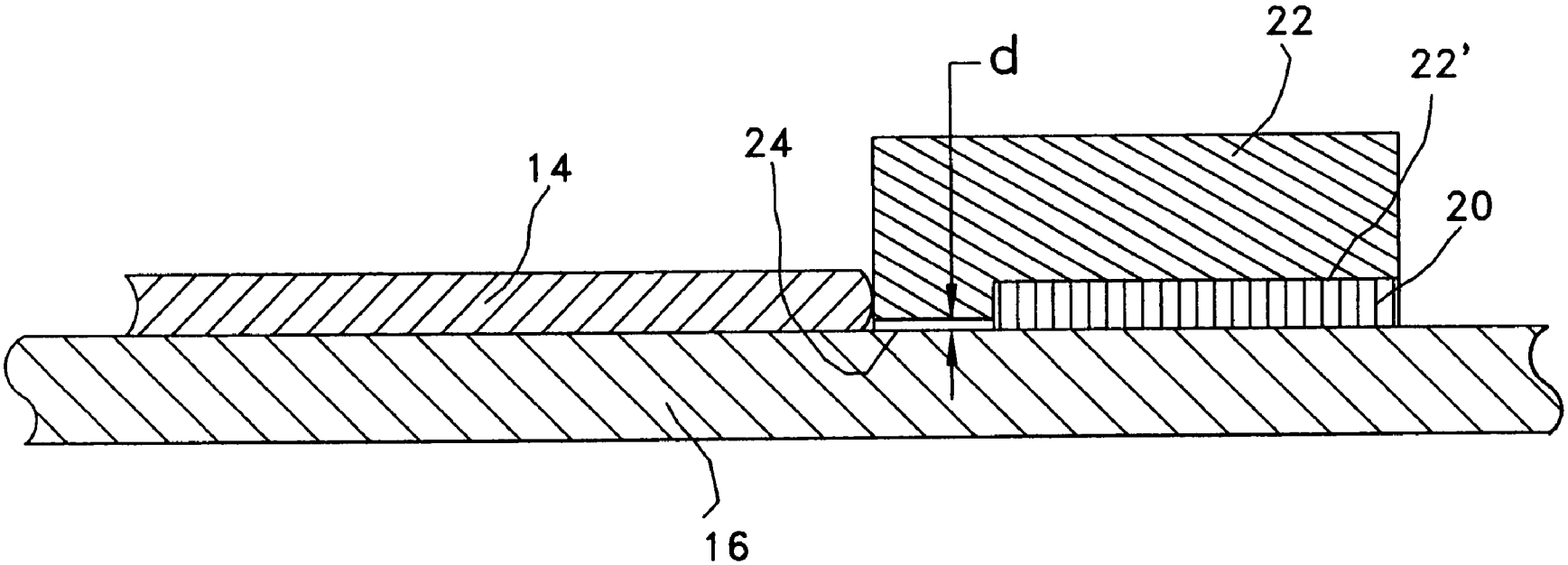
FIG. 3 is a cross section of a second embodiment of the retaining ring with wear pad for use in CMP processes, wherein the wear pad is inserted into the lower portion of the retaining ring such that the wear pad is in contact with the polishing pad, with the portion of the retaining ring contacting the wafer at its inside diameter being relieved at the bottom so as not to contact the polishing pad.

FIG. 3 is a cross section of a second embodiment, wherein a relatively thick annular wear pad 20 is inserted into a bottom, outer annular, cutout portion 22 of retaining ring 22, such that the wear pad 20 is in contact with the polishing pad 16. The portion of the retaining ring that contacts the wafer 14 at its interior annular surface has a relieved section 24 at its the bottom thereof, so that retaining ring proper does not contact the polishing pad 16. The relieved section 24 extends outwardly from the interior annular surface toward the exterior, or outer, annular surface of the retaining ring, such that it extends until reaching the interior annular surface of the wear pad 20. Preferably, but not required, the relieved section 24 has a depth "d", as measured from the top toward the bottom of the retaining ring, that is less than the depth, or height, of the wear pad 20, as seen in FIG. 3. The wear pad 20 protrudes about 0.010 inches or less beyond this relieved section 24, so that the retaining ring material never contacts the polishing pad. Thus, again, the wear pad withstands heat and abrasion from the polishing pad while the retaining ring.

Figure 4:
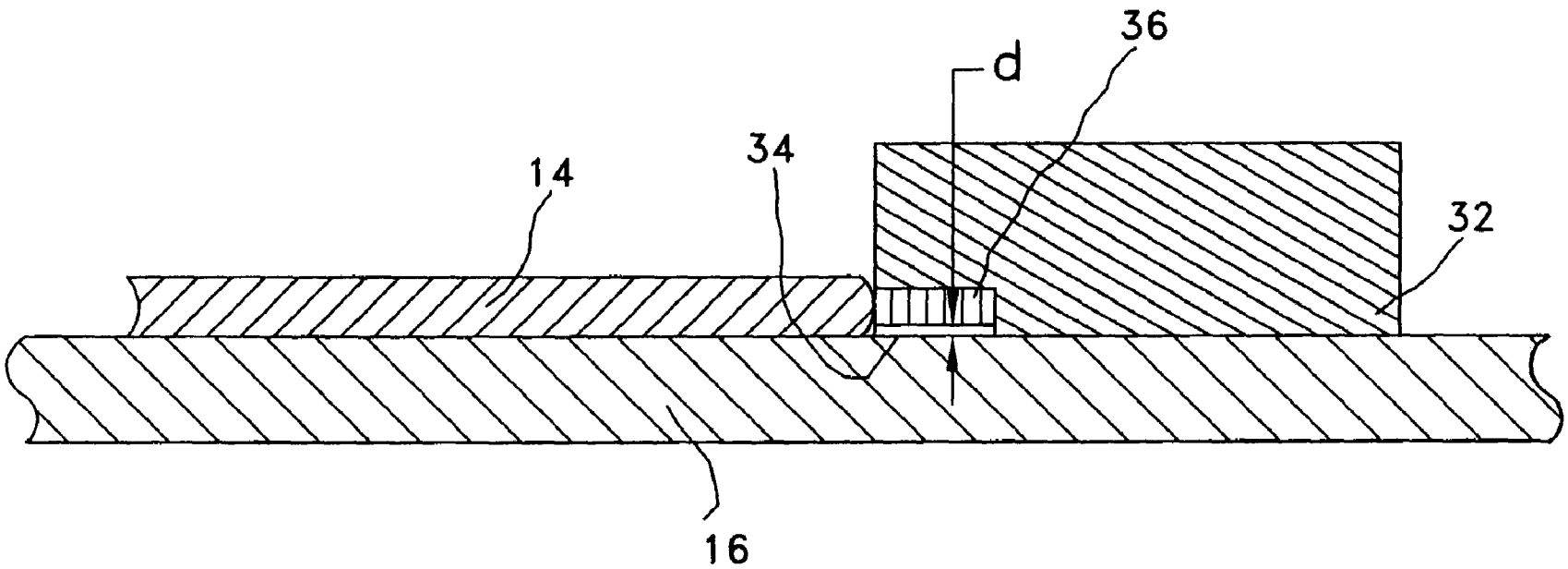
FIG. 4 is a cross section of a third embodiment of the retaining ring with wear pad for use in CMP processes, wherein the wear pad comprises the bulk, but not all, of the retaining ring, there being a small, ring-shaped section of suitable thermoplastic material is inserted into the lower inside diameter of the wear pad to act as a bumper against the wafer, with there being a gap between the thermoplastic material and the polishing pad, so that the thermoplastic ring does not contact the polishing pad.

FIG. 4 is a cross section of a third embodiment, wherein the annular retaining ring 32 is comprised of wear-pad material, thus effectively making the retaining ring 32 one large wear pad itself. The retaining ring 32 is formed with a bottom, interior annular cutout section or portion 34, in which is adhered, or otherwise formed, a relatively small, interior, annular or ring-shaped force-absorbing insert 36, of a suitable thermoplastic material, such as PPS, in order to act as a bumper against the wafer 14 during polishing. There is a gap "d" between the bottom surface of the annular, force-absorbing insert 36 and the bottom surface of the retaining ring, so that the force-absorbing ring 36 does not contact the polishing pad 16. The bottom surface of the annular retaining ring/wear pad combination protrudes preferably about 0.010 inches or less below the insert 36, so as to effectively provide a wear-pad section that resists the heat and abrasion of the polishing operation.

Figure 5:
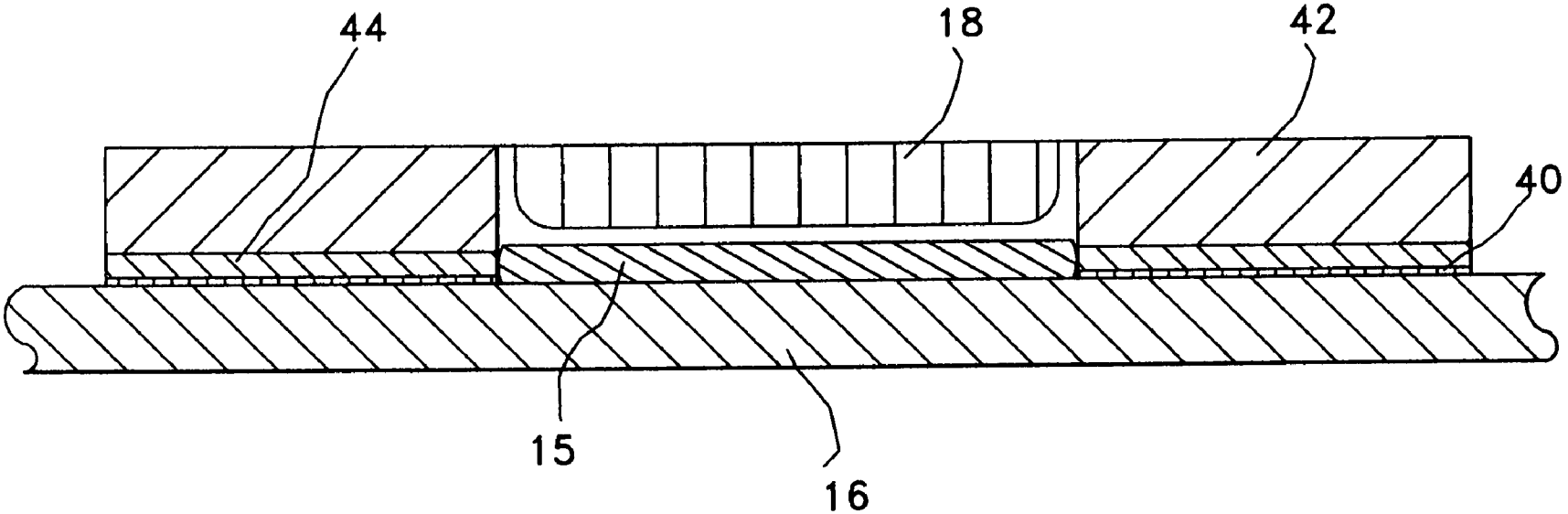
FIG. 5 is a cross section of a fourth embodiment of the retaining ring with wear pad for use in CMP processes, wherein a thin wear pad (0.010 thousandths of an inch or less) is adhesively attached to an insulating material that is adhesively attached to the retaining ring body, whereby as heat is generated at the interface of the semiconductor wafer and the polishing pad, the heat is retained by the wafer and polishing pad, thus increasing the interface temperature and thereby increasing the rate of removal in some CMP applications.

FIG. 5 is a cross section of a fourth embodiment, wherein a thin, annular wear pad 40 of approximately 0.010 thousandths of an inch or less is adhesively, or otherwise, attached, to an annular, insulating-material ring 44 that is itself adhesively, or otherwise, attached to the annular retaining ring 42. Heat generated at the interface of semiconductor wafer 15 and the polishing pad 16 is retained by the wafer and polishing pad by means of the annular, insulating-material ring 44, thus increasing the interface temperature and thereby increasing the rate of removal in some applications. The interior annular surface of the annular, insulating-material ring 44 itself contacts against the wafer 15 for securing the wafer during the CMP polishing process, to thus enhance heat-retention. Conversely, if a CMP operation were advantageously desired to be run in a cool state, this insulation effect would also serve to enhance performance.

Figure 6:
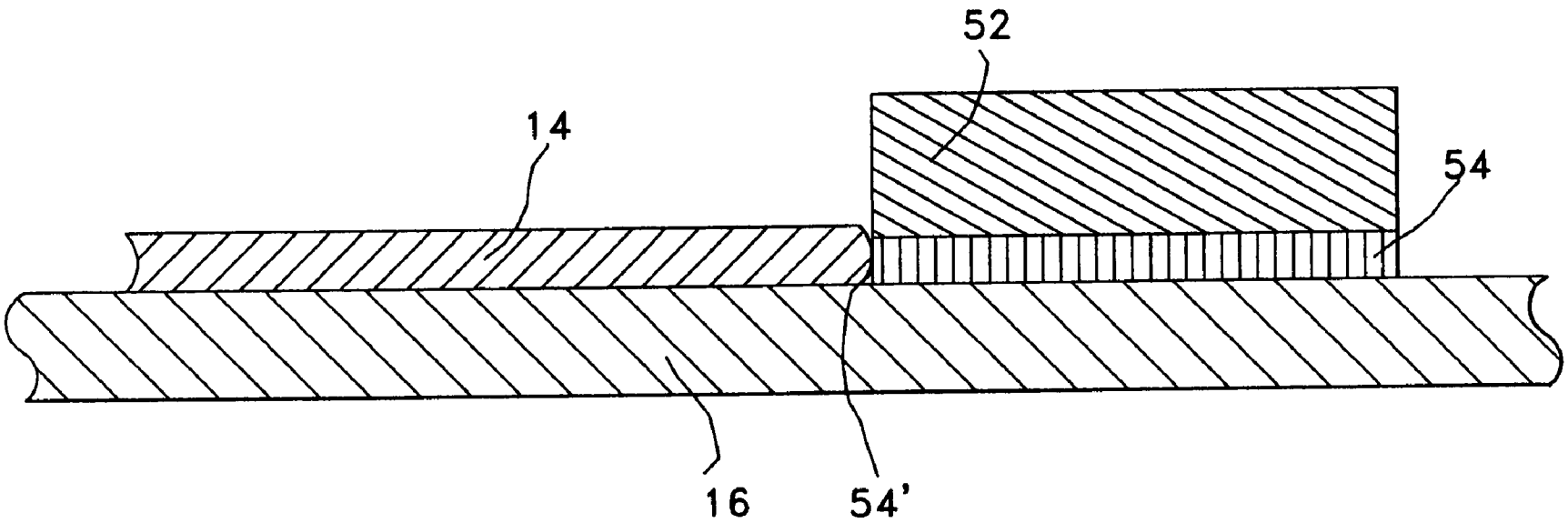
FIG. 6 is a cross section of a fifth embodiment of the retaining ring with wear pad for use in CMP processes, wherein the entire working surface of the retaining ring is the wear pad material of the invention, and where the wear pad serves both as the wear material and as the wafer retainer material, with the primary advantage being that the material can wear more than 0.010 thousandths of an inch before replacement.

FIG. 6 is a cross section of a fifth embodiment, which is a combination of the embodiments of FIGS. 1 and 4, wherein the bottom and interior annular working surfaces of the retaining ring 52 is an annular retaining wear pad 54 of the invention. In this embodiment, the annular wear pad 54 acts as the bumper against the wafer 14 via its interior annular surface 54'. The remainder of the retaining ring is made of PPS, or the like, as in conventional retaining rings. The net effect of this embodiment is to replace the nonmetallic working component of a retaining ring with the novel wear-pad material of this invention in its entirety.

Figure 7A:
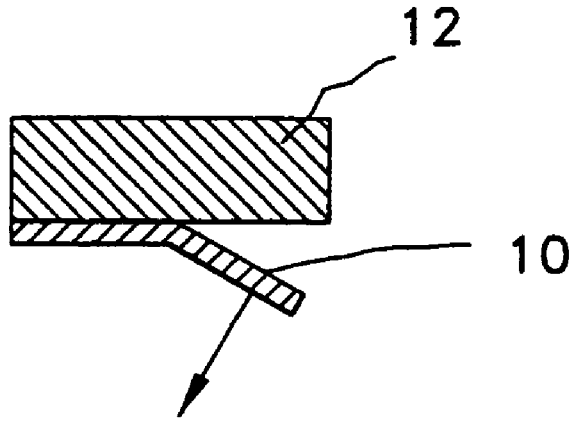
FIGS. 7A and 7B are cross sections similar to FIG. 1 and showing the replacement of the wear pad of FIG. 1, after it has become worn out, by peeling the worn one off and attaching another, new wear pad of the invention.
Figure 7B:
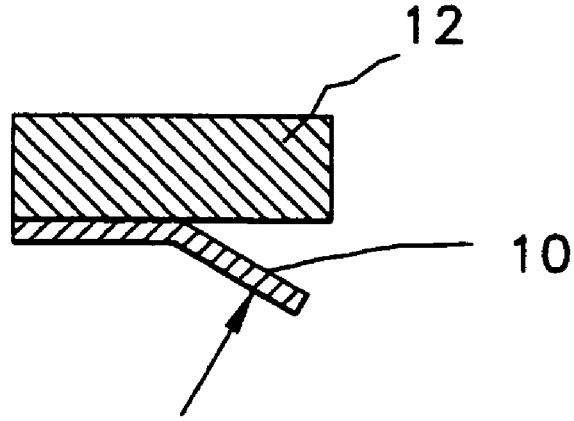

With respect to the capability of modifying or retrofitting existing prior-art retainer rings, any of the above-mentioned embodiments may be used. For the embodiment shown in FIG. 1, the thin wear pad may be adhesively or otherwise attached to used or new retaining rings. After the wear pad 10 of FIG. 1 has become worn, it may be removed and replaced with another, new wear pad 10 in the same manner as the worn one was applied, such as adhesively, by simply peeling off the old, worn pad 10, as seen in FIG. 7A, and replacing it with the new pad 10, as seen in FIG. 7B. In typical CMP apparatuses, a certain amount of retainer-ring wear is acceptable and compensated for by the machine. When the ring has been worn down, the wear pad may be attached. By doing so, the overall thickness may be returned to the operational range. Conversely, for a new retainer ring, depending on the overall thickness, the wear pad may be simply attached without modification or a small thickness of the working surface may be removed prior to attachment. Similar approaches may be used for the wear pads of the embodiments of FIGS. 3, 5 and 6. In any of these cases, the metallic core of the retaining ring is reused. In any of the above-described embodiments, the existing, prior-art, retainer ring material may be removed in entirety, and replaced with the wear pad of the invention.

What is claimed is:

1. A retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, comprising;

a main body portion, said main body portion having a bottom portion for contacting against a polishing pad during wafer-polishing, and also having an interior annular surface for holding a wafer; and said bottom portion of said main body portion being made of fibrous material impregnated with a thermosetting resin.

2. The retaining ring according to claim 1, further comprising an inner absorption means mounted to said main body portion against which a wafer is secured by abutting contact, said inner absorption means absorbing impact from the wafer during the polishing process.

3. The retaining ring according to claim 2, wherein said bottom portion of said main body portion is stepped and defines an interior annular cutout section; said inner absorption means comprising annular ring means being mounted in said annular cutout section.

4. The retaining ring according to claim 3, wherein said inner annular absorption ring means has a depth less than the depth of said interior annular cutout section, whereby the bottom surface of said absorption ring means is spaced from, and does not contact, a polishing pad during a wafer-polishing process.

5. The retaining ring according to claim 2, wherein said inner absorption means is made of thermoplastic material.

6. The retaining ring according to claim 1, wherein at least said bottom portion of said main body portion comprises hard abrasive particle additive for conditioning a polishing pad as said bottom portion contacts the polishing pad during the polishing process.

7. A method of using a retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, said retaining ring comprising a main portion having a bottom surface and a replaceable bottom wear pad secured to said bottom surface of said main portion for contacting against the polishing pad during the polishing process of the wafer secured in the retaining ring, comprising:

(a) using the bottom wear pad during wafer-polishing in a CMP apparatus by contacting the wear pad against the polishing pad during the polishing process, said step of using contacting only said bottom wear pad against the polishing pad and leaving the main portion of said retaining ring out of contact with the polishing pad during the polishing process; and (b) replacing the wear pad of step (a) from said bottom surface with another wear pad when the wear-pad of said step (a) has been used up, whereby the main portion of the retaining ring need not be replaced, said step of replacing comprising removably attaching the another wear pad to said bottom surface of said main portion.

8. The retaining ring according to claim 7, wherein said step (b) comprises inserting insulating layer means between said main portion and said wear pad, whereby heat generated during the wafer-polishing process is retained in order to provide wafer-polishing at elevated temperatures.

9. A retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, comprising;

a main body portion, said main body portion having a bottom portion, and also having an interior annular surface; and replaceable wear pad means removably secured to said bottom portion of said main body portion for contact against the polishing pad during the polishing process of the wafer secured in the retaining ring, whereby when said wear pad means is used up, it is replaced with another said wear pad means.

* * * * *